United States Patent [19]

Belknap

[11] Patent Number: 4,911,086

[45] Date of Patent: Mar. 27, 1990

[54] SUPPORT STRUCTURE FOR WEIGHTY OBJECTS

[76] Inventor: John H. Belknap, 29 Indian Mill Rd., Cos Cob, Conn. 06807

[21] Appl. No.: 192,171

[22] Filed: May 10, 1988

[51] Int. Cl.[4] ..... A47B 3/06

[52] U.S. Cl. ..... 108/153; 248/165; 297/442

[58] Field of Search ..... 108/111, 153, 155, 157; 211/181, 182; 248/165, 188; 297/439, 442, 443

[56] References Cited

U.S. PATENT DOCUMENTS

| | | | |
|---|---|---|---|
| 3,078,957 | 2/1963 | Larson | 248/188 |
| 3,521,579 | 7/1970 | Stafford | 108/153 |
| 4,182,432 | 1/1980 | Cossitt | 297/442 |
| 4,287,837 | 9/1981 | Bayles | 248/188 |
| 4,372,224 | 2/1983 | Ehrlich | 108/153 |
| 4,645,161 | 2/1987 | Collins | 248/188 |

*Primary Examiner*—Peter R. Brown
*Assistant Examiner*—Brian K. Green
*Attorney, Agent, or Firm*—Alfred E. Miller

[57] ABSTRACT

A compact bench or other support structure assembled from a small number of interconnected parts and having a multiplicity of load bearing surfaces resulting in the maintenance of the structural rigidity of the assembled structure even when supporting weighty loads.

6 Claims, 5 Drawing Sheets

FIG.2
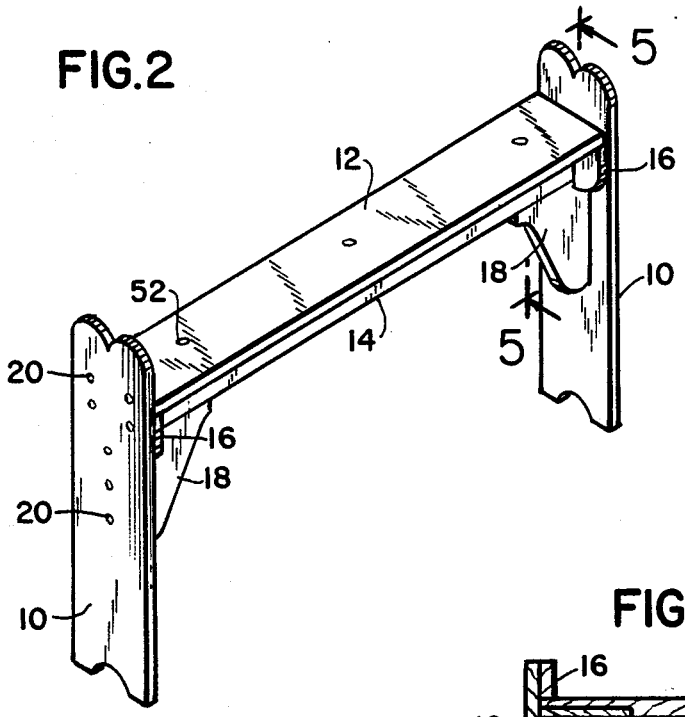
FIG.3
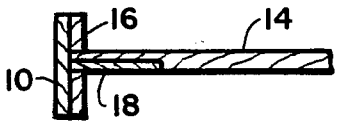
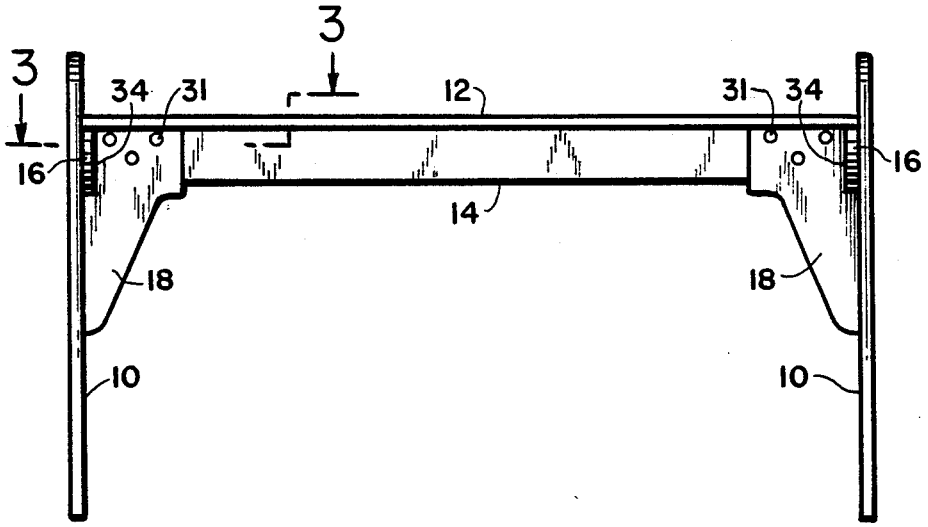
FIG.4

FIG.6
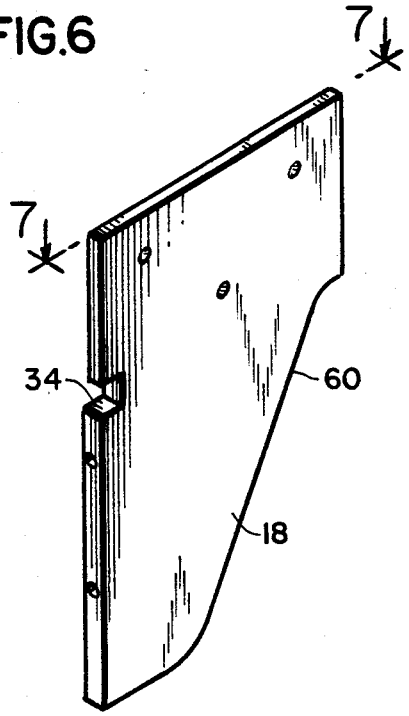
FIG.8
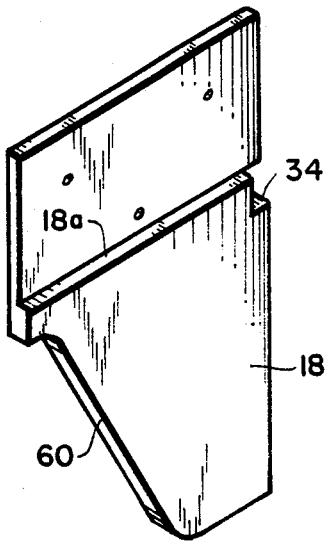
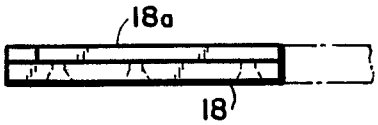
FIG.7
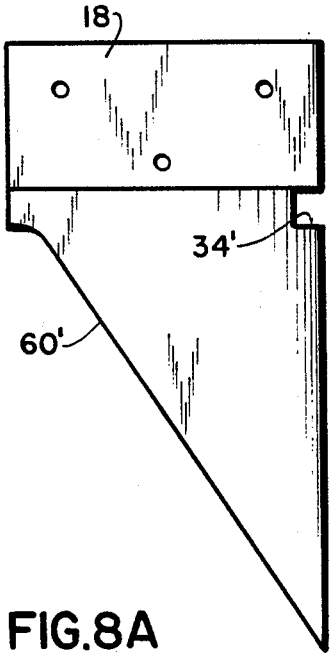
FIG.8A

SUPPORT STRUCTURE FOR WEIGHTY OBJECTS

The present invention relates to a compact support structure or bench for heavy objects which is provided with a plurality of interconnecting, load bearing surfaces that are reinforced by the use of connecting machined elements. The bench parts are pre-cut from wood or other suitable stock and then assembled.

It is an object of the present invention to provide a support structure which can be assembled from pre-cut parts, for subsequent disassembly and reassembly, without weakening the overall strength and rigidity of the structure. Thus, the structural integrity of the structure is maintained.

It is another object of the present invention to provide a support structure for weighty objects such as planters or aquariums. The support structure is in the form of a bench or a table which is relatively narrow in depth and is supported by spaced end pieces. The support structure is further provided with a stringer and stringer supports as well as additional vertical stringer supports.

It is a further object of the present invention to provide sufficient intersupporting load-bearing surfaces so that the support or bench can be manufactured from relatively lightweight wood or other material while preserving the capability of supporting weighty objects and remaining itself light in weight as well as rigid.

It is a feature of the present invention to provide a support structure or bench which can, if the builder desires, be simply assembled, disassembled, and reassembled without gluing, and by means of the use of threaded inserts placed in drilled holes and coupled with appropriate machine fastening elements. Furthermore, the structure can be easily and economically manufactured from wood or any other suitable material that can be cut and drilled. Ease of manufacture is increased by all cuts and drillings of the wood or other material being generally perpendicular (90°) to the surface being cut.

It is a further object of the present invention to provide a rigid bench which will show no distortion even after many years of supporting heavy objects and repeated disassembly and reassembly.

It is another feature of the present invention to provide spaced end pieces and stringer supports that have certain non-load bearing edges that can have selected decorative designs.

It is an additional object of the present invention that it can be manufactured within a variety of dimensions of length and height without degradation of any of the aforementioned attributes and features.

In order that the present invention will be more clearly understood, it will now be disclosed in greater detail with reference to the accompanying drawings in which:

FIG. 2 is a perspective view from the front of the assembled support structure or bench.

FIG. 3 is a sectional view taken along the lines 3—3 of FIG. 4.

FIG. 4 is a side elevational view from the back of the support structure shown in FIG. 2.

FIG. 6 is a perspective view on an enlarged scale of the vertical stringer support shown in FIG. 1.

FIG. 7 is a top plan view taken along the lines 7—7 of FIG. 6 including the end portion of the longitudinal stringer.

FIG. 8 is a perspective view of the reverse side of the vertical support shown in FIG. 6.

FIG. 8A is a perspective view of a decorative modification of the non-load bearing surface of the vertical stringer support shown in FIG. 8.

Figure 1:
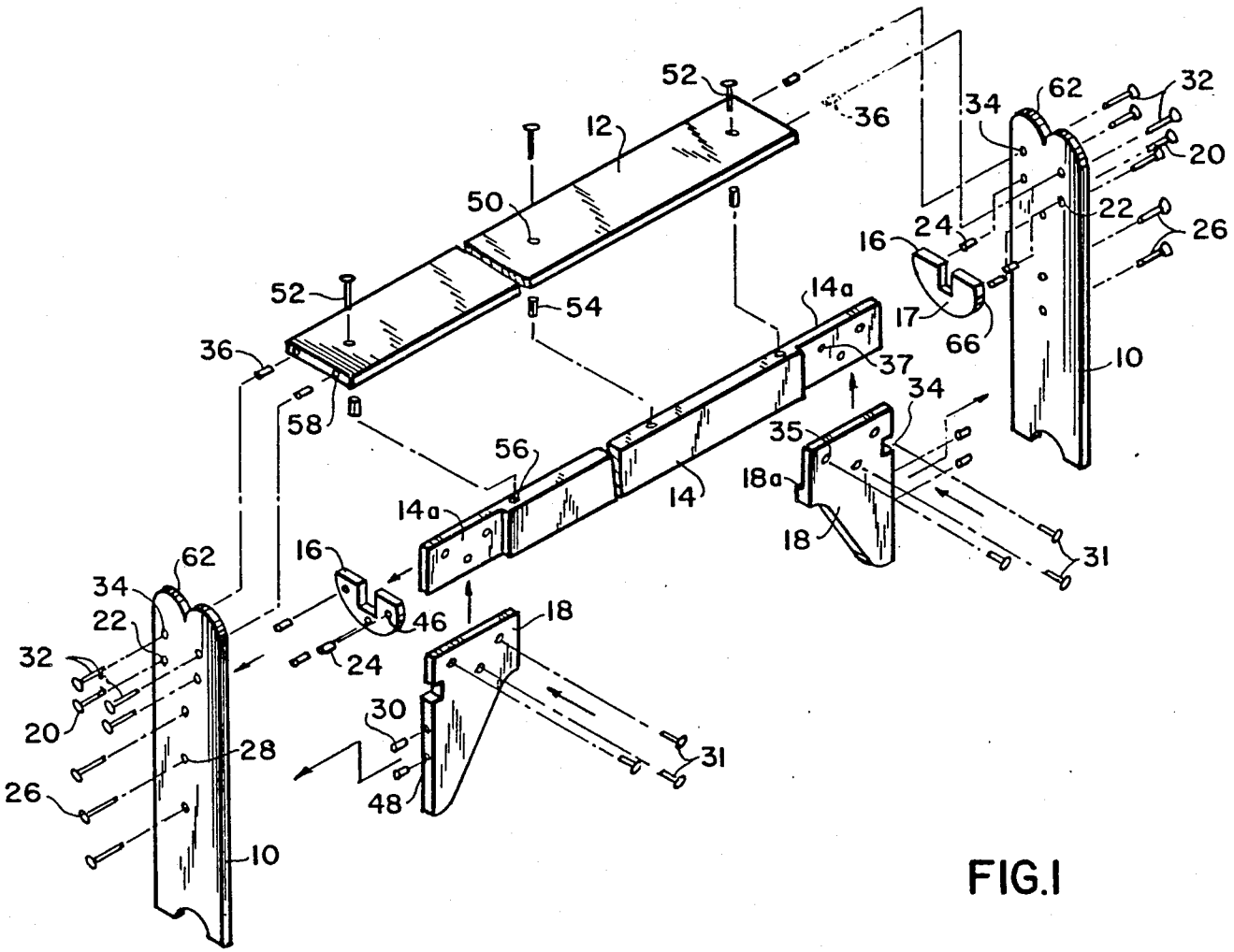
FIG. 1 is an exploded perspective view of the present support structure or bench constructed in accordance with the teachings of my invention.

Referring to FIGS. 1-5, the support structure or bench comprises spaced end pieces or panels 10 which are adapted to rest on the floor or the like and supports the bench top 12 by means of a stringer 14 mounted in flush stringer supports 16, each being affixed to an adjacent end piece 10. In addition, the reduced end parts **14*a* of the stringer 14 further are mounted on a pair of vertical stringer supports 18 that are also affixed to the respective end pieces as well as to the reduced part 14*a* of the stringer 14**. Further, as seen in FIG. 1, a multiplicity of part connecting machine screws and wood screws are shown, as well as threaded inserts for receiving screw threads of the machine screws for easy and rapid assembly, disassembly, and reassembly of the bench or support structure.

Machine screws 20 pass through holes 22 on end piece 10 and further are screw connected with threaded inserts 24 in the flush stringer support 16. A further set of machine screws 26 pass through holes 28 into threaded inserts 30 in the marginal edge of the vertical stringer support 18. These procedures are duplicated at the other end of the support or bench.

Figure 5:
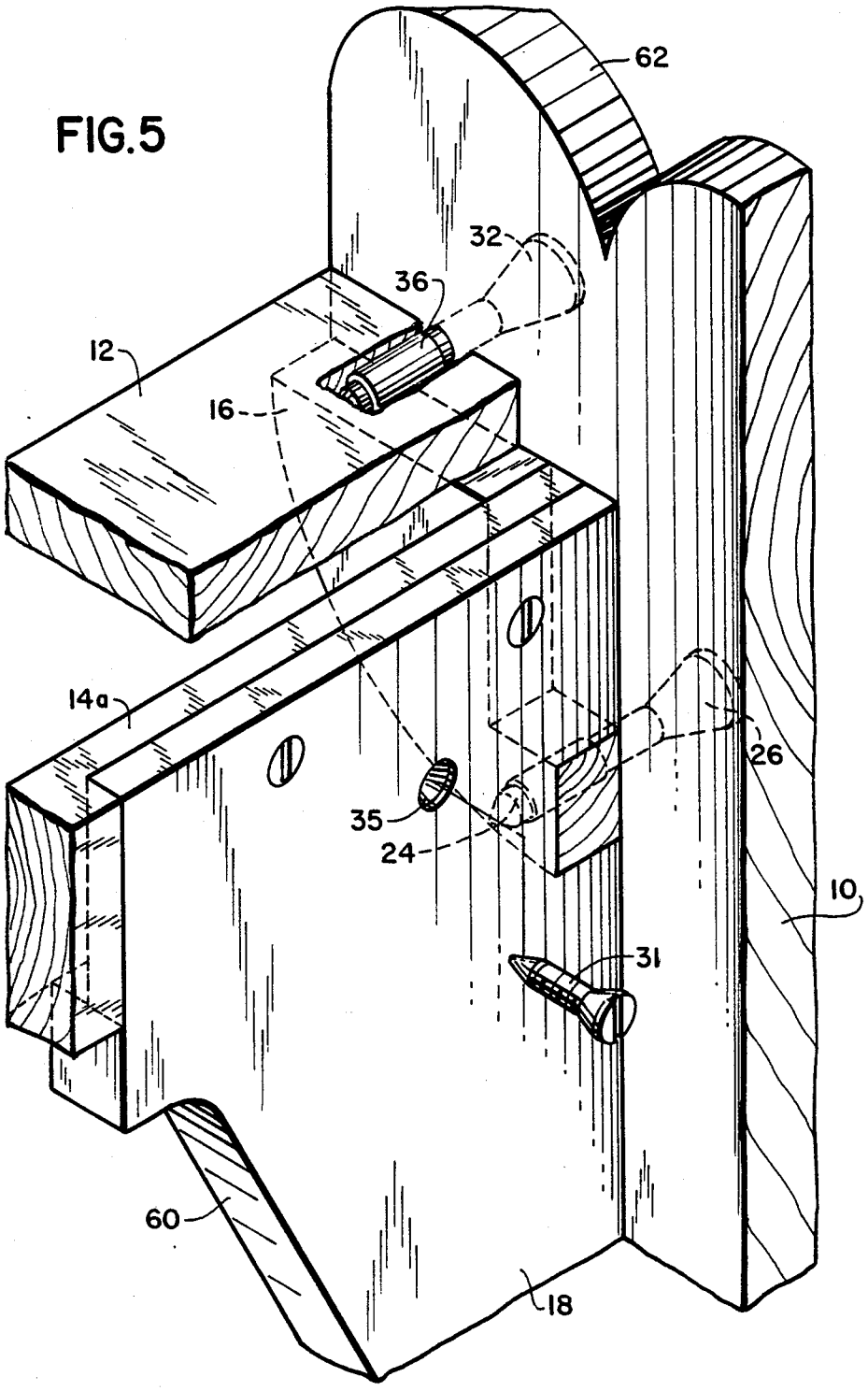
FIG. 5 is an enlarged, partial perspective view of the details of construction and assembly of my invention.

Referring to FIGS. 1, 3 and 5 it will be noted that the stringer 14 is supported at each end by vertical stringer supports 18. The latter is provided with scarfed or cutaway portions **18*a* while the reduced end parts 14*a* of the stringer 14 interfit with the scarfed end portions 18*a* of the vertical stringer supports 18, the bottom surface of the scarfed end portion 18*a* becoming the load bearing surface for the stringer 14. As seen in FIGS. 1, 5 and 7, each stringer support 18 is removably connected to the stringer 14 by means of wood screws 31 passing through holes 35 of the stringer support and into but not through the reduced end parts 14*a***.

As seen in FIGS. 1 and 5, the flush stringer supports 16 each have a notch 17 opening from the top thereof. The notch 17 of each support 16 receives the extreme reduced ends **14*a* of the stringer 14 and a portion of the top rear of the vertical stringer support 18. As shown in FIGS. 1, 5, 6, and 8, the vertical stringer supports 18 have a notch 34 whose top is flush with the bottom of the scarfed out portion 18*a* and whose bottom is positioned to accept snugly the remaining portion of flush stringer 16 below notch 17. Thus, both notches 17 and 34** provide additional load bearing surfaces.

The flush stringer supports 16 are affixed to the inside of the end panels 10 in confronting relationship by means of machine screws 20, or the like, passing through drilled holes 22 in the end panels 10 and are screw connected into the threaded inserts 24 in aligned blind holes 46 in the flush stringer support 16. It should be evident that the flush stringer supports 16 can be easily assembled to and disassembled from the adjacent end panel 10.

The vertical stringer supports 18 are affixed to the end panels 10 by means of machine screws 26 passing through holes 28 in the end panels 10 and being screw connected to threaded inserts 30 in aligned holes 48 in the inner edge of vertical stringer support 18.

As seen in FIG. 1, the bench top 12 is provided with spaced through holes 50 through which machine screws 52 are screw connected with threaded inserts 54 in aligned holes 56 in the top edge of stringer 14. In addition, the ends of bench top 12 are affixed to end panels 10 by means of machine screws 32 passing through holes 34 and being screw connected with threaded inserts 36 in aligned holes 58 in the ends of bench top 12.

It should be apparent that the load bearing top 12 of the bench bears on the stringer 14 and the tops of stringer supports 16 and 18. In turn, stringer 14 bears on the bottom of the scarfed out portion 18*a* of support 18, and both stringer 14 and vertical support 18 bear on the bottom of notch 17 in flush stringer support 16 which in turn bears on the bottom of notch 34 in support 18, with lateral movement of the end pieces 10 being prevented by machine screws 20, 26, 31, and 32 being affixed as described. Thus, the present construction for a support or bench for holding heavy objects such as planters or aquariums is relatively narrow in depth yet has a requisite strength and rigidity to support weighty objects without distortion of the structure. Furthermore, the assembly can be taken apart and put together easily since the part connecting elements are machine or wood screws without any use of glue or other bonding agent.

FIGS. 6 and 8 show the decorative edge 60 of the vertical stringer supports 18 as shown in FIGS. 1, 2, 3 and 5. FIG. 8A shows one of many possible variations of this decorative non-load bearing edge designated by the same reference numeral but primed as 60'. All other abutting and load bearing surfaces remain unchanged.

Figure 9:
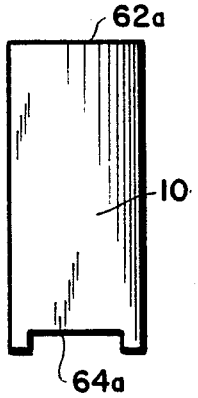
FIGS. 9, 10 and 11 are front elevational views on a reduced scale showing various decorative configurations of the non-load bearing surfaces of the end supports for my bench structure shown in FIG. 1.
Figure 10:
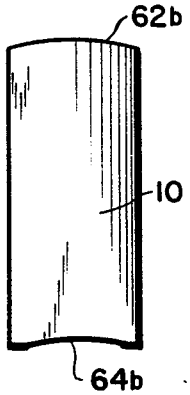
Figure 11:
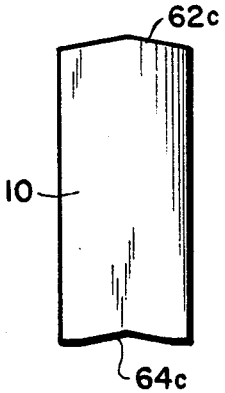
Figure 12:
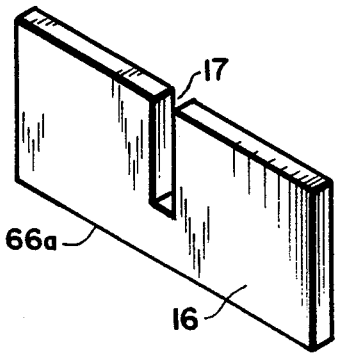
FIGS. 12 and 13 are perspective views of various decorative configurations of the non-load bearing surfaces of the flush stringer supports shown in FIG. 1.
Figure 13:
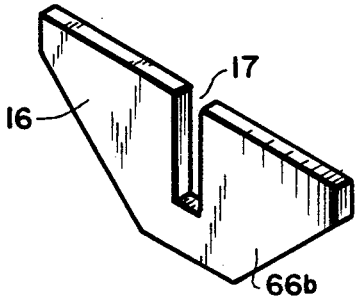

FIG. 1 shows decorative non-load bearing edges 62 of end pieces 10. FIGS. 9, 10 and 11 show some of the possible variations of these variations as 62*a*, 62*b*, 62*c* and 64*a*, 64*b*, 64*c*. These edges have no effect on the load bearing capacity of the bench or support. FIGS. 12 and 13 show variations 66*a* and 66*b* of the decorative non-load bearing edges of the flush stringer supports 16 shown as feature 66 in FIGS. 1, 2, and 5.

While the invention has been disclosed and described herein with reference to several embodiments thereof, it is apparent that other variations and modifications of my invention may be made which fall within the true spirit and scope of the invention as defined in the following claims.

I claim:

1. A compact support structure having a plurality of load bearing surfaces comprising: a pair of spaced end panels, an elongated stringer disposed between and generally perpendicular to said end panels, the opposite ends of said stringer being reduced in width, a pair of flush stringer supports each removably connected to an inside surface of said spaced end panels in confronting relationship, a pair of vertical stringer supports each interconnected with an adjacent flush stringer support said flush stringer supports and vertical stringer supports each having top load bearing surfaces, said elongated stringer being connected at said opposite reduced ends together with a portion of the top of an adjacent vertical stringer support to a respective flush stringer support, and a shelf support top connected to said stringer and resting on the top load bearing surfaces of all said stringer supports.

2. A compact support structure as claimed in claim 1 wherein each of said vertical stringer supports is provided with a notch for receiving a respective reduced end of said stringer.

3. A compact bench as claimed in claim 1 wherein said end panels, stringer, stringer supports and bench top are removably interconnected.

4. A compact bench as claimed in claim 1 wherein said load bearing surface of each of said flush stringer supports is a notch opening in the top of said support.

5. A compact support structure having a plurality of load bearing surfaces comprising: a pair of spaced end panels, an elongated stringer disposed between and generally perpendicular to said end panels, the opposite ends of said stringer being reduced in width, a pair of flush stringer supports each having top load bearing surfaces and each removably connected to an inside surface of said spaced end panels in confronting relationship, a pair of vertical stringer supports, each of said vertical stringer supports being provided with a shelf forming a load bearing surface upon which an adjacent reduced end of the stringer rests and each vertical stringer support having a top edge load bearing surface and being interconnected with an adjacent flush stringer support, said elongated stringer being connected at opposite reduced ends together with a portion of the top of an adjacent vertical stringer support to a respective flush stringer support, and a flat bench top connected to said elongated stringer and resting on the top load bearing surfaces of all of said stringer supports.

6. A compact bench as claimed in claim 5 wherein when assembled said flat bench top rests on bearing surfaces of said stringer, flush stringer supports and vertical stringer supports to form a rigid, high load capacity structure.

* * * * *